United States Patent [19]

Stone et al.

[11] Patent Number: 5,028,321

[45] Date of Patent: Jul. 2, 1991

[54] METHOD AND APPARATUS FOR WATER CIRCULATION, CLEANING, AND FILTRATION IN A SWIMMING POOL

[75] Inventors: Damon K. Stone, 5007 NW. 34th St., Ridgeway Village, Fla. 32605; Stephen A. Scott, Gainesville, Fla.

[73] Assignee: Damon K. Stone, Gainesville, Fla.

[21] Appl. No.: 280,823

[22] Filed: Dec. 7, 1988

Related U.S. Application Data

[63] Continuation-in-part of Ser. No. 888,368, Jul. 23, 1986, Pat. No. 4,832,838.

[51] Int. Cl.[5] ..... E04H 3/20

[52] U.S. Cl. ..... 210/167; 4/290; 15/1.7; 134/167 R; 210/169; 210/416.2

[58] Field of Search ..... 210/162, 163, 166, 169, 210/416.2, 167, 237, 407, 497.3; 4/490, 507, 492; 15/1.7; 134/169 R, 167 R

[56] References Cited

U.S. PATENT DOCUMENTS

| | | | |
|---|---|---|---|
| 1,637,423 | 8/1927 | Miller | 210/169 |
| 3,018,491 | 1/1962 | Read | 4/492 |
| 3,247,969 | 4/1966 | Miller | 210/169 |
| 3,321,080 | 5/1967 | Pansini et al. | 210/163 |
| 3,667,611 | 6/1972 | Pansini | 210/163 |
| 3,839,749 | 10/1974 | Blumenfeld et al. | 210/166 |
| 3,932,281 | 1/1976 | Pansini | 210/163 |
| 4,460,462 | 7/1984 | Arneson | 210/163 |
| 4,832,838 | 5/1989 | Stone | 210/169 |

*Primary Examiner*—Robert A. Dawson
*Assistant Examiner*—Joseph Drodge
*Attorney, Agent, or Firm*—Foley & Lardner

[57] ABSTRACT

A pool cleaning device for a pool having a powered water circulation and filtration system including at least one return inlet. The inlet is directed to create a circular flow pattern of water in the pool so as to cause debris therein to become concentratedly swirled at the pool bottom. The pool cleaning device of the present invention is provided adjacent to the drain on the pool bottom and provides a vortex of water extending upwardly from the pool bottom. The device includes a housing having at least one inlet and at least one outlet. A shroud is connected to the housing and has at least one inlet and at least one outlet. The debris moves from the shroud inlet to the shroud outlet due to the vortex. A debris collection device is connected to the shroud. Movement of the water and the debris is permitted into the debris collection device and the debris is limited from returning to the shroud. The device may be sealingly seated over the drain on the pool bottom whereby the device directs a portion of the pool water downward to the drain which provides power to produce the upward vortex. Thus, the device is powered by the normal suction force at the drain caused by the water circulation and filtration system.

12 Claims, 3 Drawing Sheets

METHOD AND APPARATUS FOR WATER CIRCULATION, CLEANING, AND FILTRATION IN A SWIMMING POOL

This is a continuation-in-part application of U.S. Ser. No. 888,368 now U.S. Pat. No. 4,932,838 filed July 23, 1986, incorporated by reference herein.

BACKGROUND OF THE INVENTION

The present invention relates to water circulation and filtration apparatus, and particularly to such apparatus as used in swimming pools.

A major problem associated with the maintenance of swimming pools, particularly outdoor pools, is the removal of debris such as dirt, leaves, trash and the like, which can accumulate both on and below the water surface as a result of normal use. To remove such debris, the pool is usually provided with a circulation pump and filter system, the filtration being effected by passing a stream of water from the pump discharge through one or a series of filters and thereafter returning the filtered stream to the pool.

This type of filtration is generally adequate for removal of small debris particles. Care must be taken, however, to prevent entrainment of large debris into the pump suction, as this can result in damage to the pump and/or clogging of the filter system. Large material is therefore excluded from the pump suction stream through a grating or like structure at the stream entrance.

Two problems are associated with this arrangement. First, large pieces of debris may adhere to the suction stream grating, thereby excluding flow to the circulation pump. Second, the large debris must be removed from the pool through some external means, such as manual skimming of the water surface. Manual skimming is, however, a time consuming procedure. Further, skimming does not provide for recovery of large debris which cannot be brought readily to the water surface, that is, debris having a neutral or negative buoyancy.

The foregoing illustrates limitations known to exist in present devices and methods. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

It is accordingly an object of the invention to provide a method and apparatus for circulating and filtering a body of water, such as in a swimming pool, wherein large debris can readily be removed.

It is another object of the invention to provide a method and apparatus, as above, which reduces or eliminates the need for manually skimming the surface of the body of water to remove debris.

It is yet another object of the invention to provide a method and apparatus, as above, which can be adapted to an existing pool filtering system having a circulation pump.

It is still another object of the invention to provide a method and apparatus, as above, which prevents entrainment of large debris into the suction of the circulation pump.

It is yet another object of the invention to provide a method and apparatus, as above, which provides an upward flow of water from the bottom of the pool for entrapping debris carried from the pool bottom by the upward flow.

It is still another object of the invention to provide a method and apparatus, as above, which provides for an upward flow of water from the pool bottom by utilizing the suction stream of the circulation pump as a power source, thereby reducing energy and maintenance costs.

In one aspect of the present invention, these objects are achieved by a pool cleaning device for a pool having a powered water circulation and filtration system including at least one return inlet. The inlet is directed to create a circular flow pattern of water in the pool so as to cause debris therein to become concentratedly swirled at the pool bottom adjacent the drain. The pool cleaning device of the present invention is provided over the drain and provides a vortex of water extending upwardly from the pool bottom. The device includes a housing having at least one inlet and at least one outlet. A shroud is connected to the housing and has at least one inlet and at least one outlet. The debris moves from the shroud inlet to the shroud outlet due to the vortex. A debris collection device is connected to the shroud. Movement of the water and the debris is permitted into the debris collection device and the debris is limited from returning to the shroud. The device may be sealingly seated over an associated drain in the pool bottom whereby the device directs a portion of the pool water to the drain thus providing power to produce the vortex.

The foregoing and other aspects will become apparent from the following detailed description of the invention when considered in conjunction with the accompanying drawing figures. It is to be expressly understood, however, that the drawing figures are not intended as a definition of the invention but are for the purpose of illustration only.

DETAILED DESCRIPTION OF THE PREFERRED EMBODIMENTS

Figure 3:
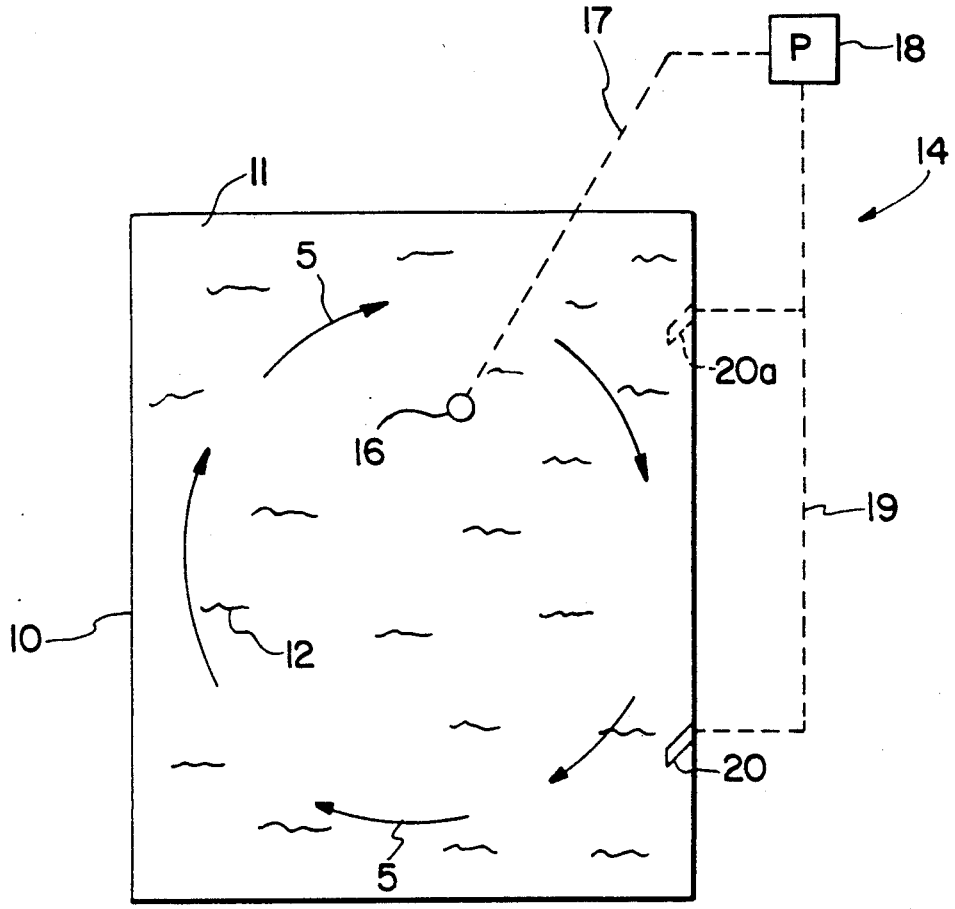
FIG. 3 is a diagrammatic view of a pool and an associated filtration system.

Referring now to the drawings, a swimming pool, generally designated 10 in FIG. 3, includes a body of water 12 which is circulated through an associated filtration system 14 including a drain 16 located at the lowest point of bottom surface 11 of pool 10, a pump and filtration device 18, an appropriate conduit 17 between the drain 16 and the pump 18, at least one return inlet 20, and another conduit 19 between the pump 18 and the inlet 20, as is well known. Such pools may also include skimmers, not shown.

Return inlets such as that designated 20 are typically movably mounted in the pool so that they can be directed in any desired direction. The present invention contemplates, therefore, that inlet 20 be directed as shown so as to create a swirling or substantially circular flow pattern in pool 10 such as is illustrated by directional arrows designated S. In the case where other return inlets are provided, as illustrated at 20*a*, those other inlets are to be directed the same as inlet 20 so as to enhance the flow pattern. In this manner, debris in the pool may be concentratedly swirled at the pool bottom and, will settle at or near the lowest point of the pool bottom which is the location of drain 16. The swirling and debris concentration are also enhanced by suction acting at drain 16 due to pump 18.

Figure 1:
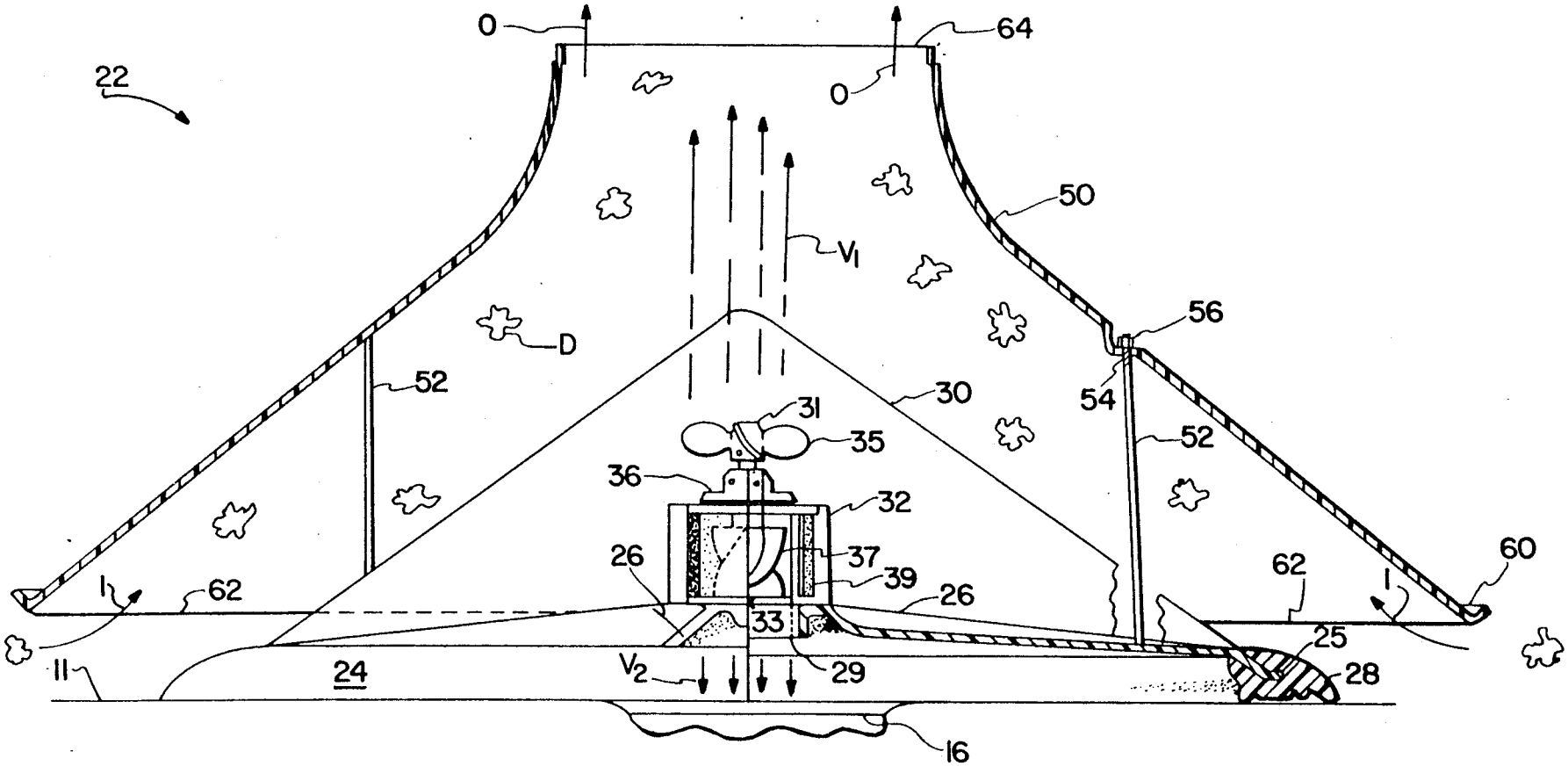
FIG. 1 is a side elevational view illustrating the pool cleaning device of the present invention in partial cross-section.
Figure 2:
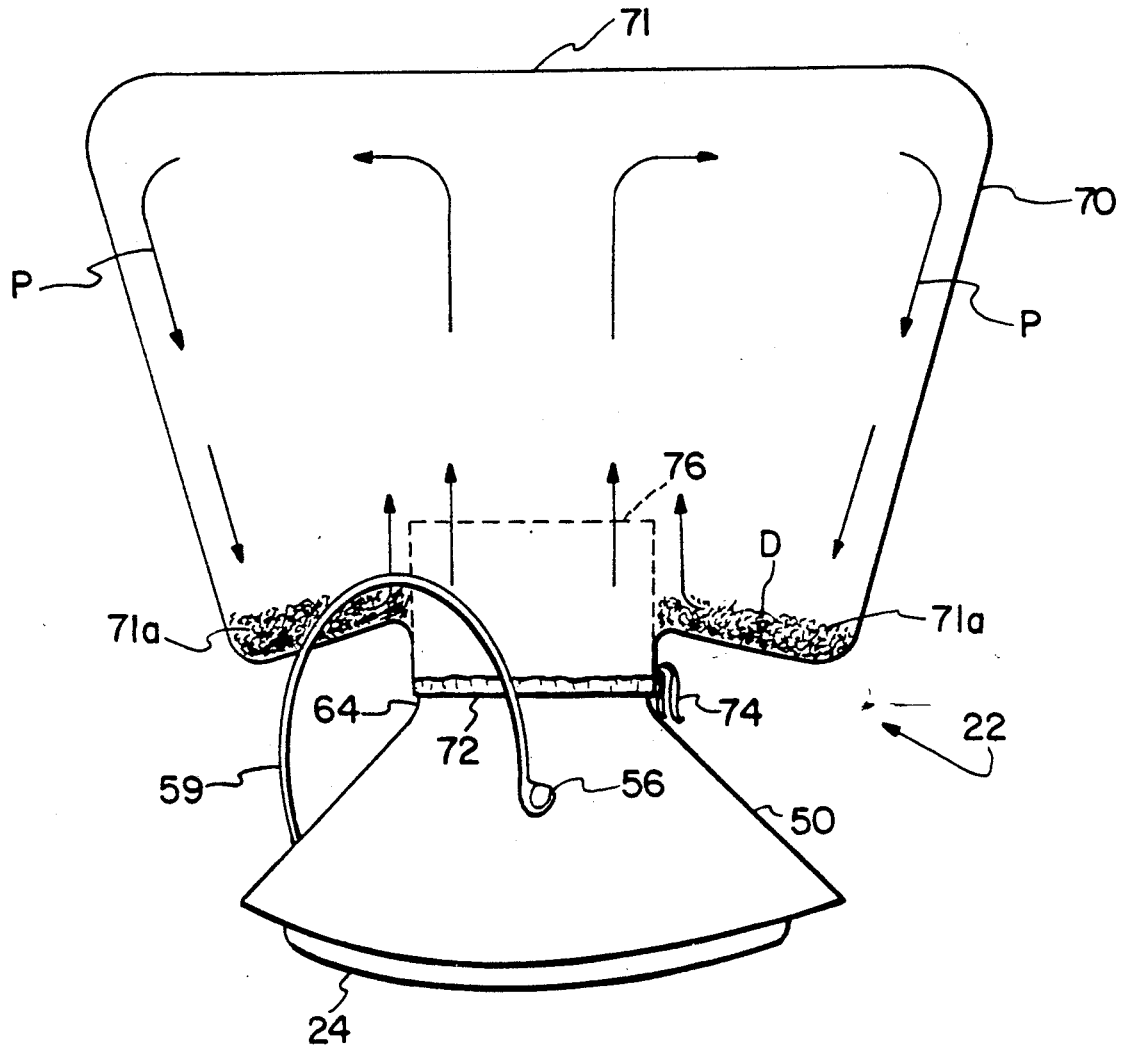
FIG. 2 is a side view of the pool cleaning device of the present invention.

The pool cleaning device of the present invention is generally designated 22 in FIGS. 1 and 2 and includes a base plate 24 preferably formed of a high impact synthetic material including reinforcing ribs 26 and having a generally circular shape. A peripheral seal 28 preferably a forty (40) durometer silicone extruded member, is attached to an outer peripheral edge 25 of plate 24. A hole 29 is formed at the geometric center of plate 24.

A dome-like, preferably conically shaped stainless steel screen or filter 30 is mounted on base-plate 24 and is of a suitable mesh to permit the passage of water and small debris to pass therethrough and limit the passage of large debris. The terms large and small debris are used in terms of well-known sizes related to pool filtration systems.

A housing 32 is mounted in hole 29. Housing 32 is also formed of a high impact synthetic material such as ABS. Screen 30 therefore limits the large debris from passing to housing 32. Housing 32 includes a freely rotatable shaft 34 bearing mounted at 36. Shaft 34 includes first and second terminal ends 31, 33 including a propulsion means 35 mounted thereon at end 31. Propulsion means 35 comprises blades of a structure sufficient for propelling a vortex of fluid in response to rotation of shaft 34. The vortex is illustrated by directional arrows designated $V_1$. A plurality of blades 37 mounted at end 33, are propelled by water drawn thereover and into drain 16 by virtue of the device 22 being sealingly seated on surface 11, as illustrated by the directional arrows designated $V_2$. In this manner, blades 35 are driven to propel the vortex $V_1$. At least one slotted peripheral inlet 39 is spirally formed in housing 32 adjacent second propulsion means 37 and permits fluid to access drain 16 in pool bottom surface 11.

A shroud 50 is mounted on base-plate 24 by means of at least three support members 52 (only two of which are shown) suitably secured to base-plate 24. Support members 52 made of flexible rubber tubes for safety reasons extend to have threaded ends 54 received in shroud 50 and secured thereto by nuts 56. Shroud 50 is preferably frusto-conically shaped and is formed of a suitable high density ABS or polyethylene. The mounting of shroud 50 on base-plate 24 is carried out by support members 52 in such screen 30. Thus, a lower peripheral surface 60 of shroud 50 is enlarged and is adjacent base-plate 24 and forms a circumferential inlet 62 therewith. An outlet 64 is formed at the geometric center of shroud 50 and is directly above and axially aligned with shaft 34 and first-propulsion means 35. A suitable handle 59 may also be secured to shroud 50 by nuts 56.

Means, such as a nylon bag 70 is connected to shroud 50 at outlet 64 for collecting debris therein. Bag 70 has an enlarged body portion 71 and includes an opening 72, smaller than body portion 71, and having a draw-string 74. Opening 72 is slightly larger than outlet 64 so as to easily be slipped over the outlet. Drawstring 74 can then be drawn to secure bag 70 to shroud 50. A vinyl tubular member 76, at opening 72 extends into bag 70 and has an inner dimension substantially the same as opening 72. Enlarged body portion 71 has a collecting area 71*a* adjacent tubular member 76 whereby debris entering bag 70 via opening 72 is circulated in a pattern illustrated by directional arrows designated P such that debris settles in collecting area 71*a* adjacent opening 72 and tubular member 76, by virtue of its extension into bag 70 functions as a one-way check valve to limit debris in bag 70 from returning to shroud 50.

From the foregoing, it can be seen that cleaning device 22 can be sealingly seated on pool bottom surface 11 via seal 28. Suction created by pump 18 draws pool water through drain 16. However, with the device 22 sealingly seated over drain 16 as illustrated in FIG. 1, water and debris having become concentrated on the pool bottom adjacent drain 16, are drawn by the suction to inlet 62 as indicated by directional arrows designated I.

Once the water and debris are between shroud 50 and filter 30, propulsion means 35, being powered to rotate due to suction acting at drain 16, directs a portion of the water along the path $V_1$. The debris is deflected from drain 16 and is limited to path $V_1$ due to the presence of filter 30, so that the debris, designated D in FIGS. 1 and 2, is ejected from the shroud 50 via outlet 64 as indicated by directional arrows indicated 0.

As a result, the debris D passes into bag 70 through inlet 72 and tubular member 76, and follows the path of travel P in bag 70, whereby the debris D settles and becomes trapped in collecting area 71*a* and is limited, by member 76 functioning as a one-way check valve, from returning to shroud 50.

What is claimed is:

1. A pool cleaning device for a pool comprising a powered water circulation and filtration system including at least one drain at a bottom of a pool and at least one return inlet;

said inlet being arranged to direct a circular flow pattern of water in the pool so as to cause debris therein to become concentratedly swirled at the pool bottom;

means attached to the bottom of the pool and powered by water flowing through said drain of said circulation and filtration system for producing a vortex of water extending upwardly from the pool bottom whenever the circulation system is operating, the means for producing a vortex being attached to a housing having at least one inlet and at least one outlet;

a shroud connected to the housing, the shroud having at least one inlet and at least one outlet; and means connected to the shroud outlet for collecting the debris therein, the debris caused to move from the shroud inlet to the shroud outlet by the vortex.

2. A pool cleaning device comprising:

a base plate;

a housing mounted on the base-plate;

a rotatable shaft mounted in the housing, the shaft having opposite terminal ends;

means mounted on one end of the shaft for rotating the shaft in response to fluid being forcibly drawn thereover;

propulsion means mounted on an opposite end of the shaft adjacent the base-plate for propelling a vortex of fluid;

an inlet in the housing adjacent the one end of the shaft;

filter means connected to the base-plate for limiting debris from access to the housing inlet;

a shroud connected to the base-plate, the shroud having at least one inlet and at least one outlet, the shroud outlet being adjacent the propulsion means and the shroud inlet being adjacent the base-plate; and means connected to the shroud outlet for collecting debris therein; and means mounted adjacent the shroud outlet for permitting fluid and debris to flow from the shroud outlet into the collecting means and for limiting debris from returning to the shroud from the collecting means.

3. The pool cleaning device according to claim 2, wherein said base-plate includes reinforcing ribs.

4. The pool cleaning device according to claim 2, wherein said base-plate includes a sealing member mounted on a peripheral edge thereof.

5. The pool cleaning device according to claim 2, wherein said housing inlet includes a slotted opening and forms a spiral path from outside of the housing to inside of the housing.

6. The pool cleaning device according to claim 2, wherein the filter means comprises a conically-shaped mesh.

7. The pool cleaning device according to claim 2, including:

a plurality of supports interconnecting the base-plate and the shroud.

8. The pool cleaning device according to claim 7, wherein the shroud is supported in a spaced apart relationship with the filter means.

9. The pool cleaning device according to claim 8, wherein the shroud is frusto-conically shaped.

10. The pool cleaning device according to claim 2, wherein the means for collecting debris comprises a nylon bag secured to the shroud outlet by a drawstring.

11. The pool cleaning device according to claim 10, wherein the means mounted adjacent the shroud outlet comprises a tubular member extending from the shroud outlet into the bag.

12. The pool cleaning device according to claim 2, including:

a handle connected to the shroud.

* * * * *